US012523204B2

(12) United States Patent
Maltry et al.

(10) Patent No.: US 12,523,204 B2
(45) Date of Patent: Jan. 13, 2026

(54) METERING DIAPHRAGM PUMP COMPRISING A PROTECTIVE MEMBRANE

(71) Applicant: ProMinent GmbH, Heidelberg (DE)

(72) Inventors: Jörg Maltry, Nußloch (DE); Marc Mohr, Mannheim (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 17/955,995

(22) Filed: Sep. 29, 2022

(65) Prior Publication Data

US 2023/0102701 A1 Mar. 30, 2023

(30) Foreign Application Priority Data

Sep. 29, 2021 (DE) ..... 10 2021 125 266.0

(51) Int. Cl.
*F04B 13/00* (2006.01)
*F04B 43/02* (2006.01)

(52) U.S. Cl.
CPC ..... *F04B 13/00* (2013.01); *F04B 43/02* (2013.01)

(58) Field of Classification Search
CPC ..... F04B 43/02; F04B 13/00; F04B 45/04; F04B 45/053; F04B 45/0533; F04B 15/04; F04B 43/06
USPC ..... 417/375, 383
See application file for complete search history.

(56) References Cited

U.S. PATENT DOCUMENTS

| | | | | |
|---|---|---|---|---|
| 3,354,831 | A * | 11/1967 | Acker | F04B 43/026 417/387 |
| 3,661,060 | A * | 5/1972 | Bowen | F04B 43/009 417/63 |
| 3,668,978 | A | 6/1972 | Bowen | |
| 4,644,847 | A | 2/1987 | Wolf | |
| 2005/0115402 | A1* | 6/2005 | Hembree | F04B 43/0054 92/96 |
| 2008/0190285 | A1* | 8/2008 | Traussnigg | F04B 43/02 92/96 |

FOREIGN PATENT DOCUMENTS

| | | | |
|---|---|---|---|
| DE | 710320 | A | 2/1939 |
| DE | 2620228 | A1 | 11/1977 |
| DE | 3931516 | C2 | 10/1993 |
| DE | 60304656 | T2 | 4/2007 |
| DE | 112017003863 | T5 | 4/2019 |
| DE | 102019135153 | A1 | 6/2021 |
| EP | 0314379 | B1 | 8/1991 |

OTHER PUBLICATIONS

Search Report issued on Jul. 27, 2022 of corresponding German application No. 10 2021125 266.0; 10 pages.

* cited by examiner

*Primary Examiner* — Philip E Stimpert
(74) *Attorney, Agent, or Firm* — Maier & Maier, PLLC

(57) ABSTRACT

A metering diaphragm pump includes a metering chamber, a working chamber and a metering membrane. The metering chamber and the working chamber are separated from one another by the metering membrane. A device for moving the metering membrane back and forth between a first and a second position is provided. The volume of the metering chamber is smaller in a first position than in the second position, and a protective membrane is disposed next to the metering membrane on the working chamber side.

16 Claims, 3 Drawing Sheets

METERING DIAPHRAGM PUMP COMPRISING A PROTECTIVE MEMBRANE

FIELD

The present invention relates to a metering diaphragm pump comprising a metering chamber, a working chamber and a metering membrane, wherein the metering chamber and the working chamber are separated from one another by the metering membrane, and a device for moving said metering membrane back and forth between a first and a second position is provided. The volume of the metering chamber in the first position is smaller than in the second position.

BACKGROUND

If the metering chamber is connected to a suction connection and a pressure connection via suitable valves, metering medium can be drawn into the metering chamber via the suction connection when the metering membrane is moved from the first to the second position and metered into a conduit disposed on the pressure connection via the pressure connection when the metering membrane is moved in the opposite direction from the second position to the first position.

Such metering diaphragm pumps have been known for many years.

The movable metering membrane has to be held in some way. The metering membrane typically comprises an edge region, at which it is tensioned or clamped between two components. The metering membrane is subjected to high stresses directly adjacent to the clamping or tensioning region, because the metering membrane is continuously alternately being flexed in the one or the other direction. This alternating flexing creates a continuous back and forth of tensile and compressive stress in the material. Consequently, dents, cracks and the like can occur, in particular in the regions adjacent to the tensioned edge region of the metering membrane, which ultimately lead to premature rupture of the metering membrane.

There is therefore a risk that metering fluid can leak from the metering chamber into the working chamber, which is fundamentally undesirable. The device for moving the metering membrane back and forth can furthermore be a hydraulic device, so that then even hydraulic fluid can pass from the working chamber into the metering chamber and thus into the product to be conveyed or filled.

It is therefore absolutely imperative to prevent a rupture of the membrane. For this reason, multi-layer metering membranes comprising a device for detecting metering fluid between the multiple layers of the metering membrane have already been used. If the layer facing the metering chamber ruptures, metering fluid seeps between the layers of the metering membrane and can be detected there, e.g., in the edge region of the metering membrane.

A hydraulic drive, in which a hydraulic fluid disposed in the working chamber is pressurized in an oscillating manner, is often used in metering pumps. The movement of the metering membrane in the direction of the first position can thus easily be effected by increasing the hydraulic pressure, whereas the return movement to the second position takes place substantially as a result of the fluid pressure of the metering fluid to be conveyed provided via the suction connection. This limits the scope of application of the pump, because a certain minimum pressure has to always be present at the suction connection to ensure a reliable return movement of the metering membrane to the second position and thus reliable functioning of the pump.

DE 10 2019 135 153 A1, for example, therefore already describes the use of a single-layer metering membrane made of a metal foil. Due to the elasticity of the metal foil, the membrane can itself move back to the second position to a certain extent without the need for a corresponding drive or additional spring elements. The metering membrane is also pretensioned in one direction, so that the continuous back and forth of tensile and compressive stress in the material is eliminated and the service life of the metering membrane has been significantly improved. However, the use of a metal membrane precludes the use of multi-layer membranes, as this would disadvantageously impede the movement of the metering membrane.

SUMMARY

Based on the described background, it is therefore the object of the present invention to provide a metering diaphragm pump of the aforementioned type, which exhibits the movement characteristics determined by the metering membrane and also enables a membrane rupture indication.

Said object is achieved according to the invention by a protective membrane which is disposed next to the metering membrane on the working chamber side.

In other words, no multi-layer membrane is being used. Instead, a protective membrane, which reliably seals the working chamber from the metering chamber in the event of a rupture of the metering membrane, is disposed next to the metering membrane. This protective membrane should preferably not be mechanically coupled to the metering membrane, so that sequence of movements of the metering membrane is not disrupted by the protective membrane.

In a preferred embodiment, the metering membrane is made of an elastic material, wherein the metering membrane is preferably made of metal and is specifically particularly preferably made of a flat metal foil.

The use of a metering membrane made of an elastic material enables the use of the restoring forces of the metering membrane to move the membrane from the first to the second position. In principle, however, it would also be possible to use the elastic metering membrane to bring about or reinforce the movement from the second position to the first position.

In a further preferred embodiment, it is provided that the protective membrane is made of a different material than the metering membrane. The metering membrane can be made of a non-elastic material and/or an electrically insulating material, specifically preferably a plastic, and particularly preferably PTFE.

Using an electrically insulating material makes it possible to determine whether metering fluid is disposed between the metering membrane and the protective membrane, for example with the aid of a capacitance measurement.

In a further preferred embodiment, the protective membrane comprises at least one slot or a milled recess on its side facing the metering membrane. This allows the protective membrane to rest directly on the metering membrane and nonetheless provide space in the region of the slot or the milled recess to accommodate the metering fluid that enters as the result of a membrane rupture the metering membrane.

In a preferred embodiment, a metering membrane tensioning device is provided, which comprises two metering membrane contact surfaces that correspond to one another and between which an edge region of the metering membrane is disposed. The metering membrane thus consists of an edge region that is clamped and a flexing region that participates in the movement of the metering membrane between the first and the second position.

It is advantageous if the metering membrane tensioning device holds only the metering membrane and not the protective membrane.

In a further preferred embodiment, a protective membrane tensioning device is provided that comprises a protective membrane contact surface, between which and the metering membrane an edge region of the protective membrane is disposed. On its side facing the metering membrane, the protective membrane particularly preferably comprises at least one slot or a milled recess which extends into the edge region of the protective membrane.

This allows any metering fluid that enters the intermediate space between the metering membrane and the protective membrane to flow into the edge region of the protective membrane and, if necessary, be detected there.

In a preferred embodiment, the metering membrane contact surfaces are further away from a centre of the metering membrane or from the flexing region of the metering membrane than the protective membrane contact surface.

The tensioning of the metering membrane is thus completely independent of the tensioning of the protective membrane.

A bore, in which a membrane rupture signalling device is disposed, can be provided in the protective membrane contact surface, for example. Membrane rupture signalling devices are known in principle. For example, the protective membrane can be configured such that metering fluid can enter the bore and be detected there. Alternatively, based on the ingress of the metering fluid, the protective membrane could be configured in the region of the bore such that it expands when the metering fluid enters the bore, and said expansion is detected, for example by a corresponding switch.

In an alternative embodiment, it is provided that a textile fabric, preferably a woven fabric, a stitch bonded fabric or a knitted fabric, is disposed between the metering membrane and the protective membrane. In this case, the described milled recess or the slots can be omitted, because any entering metering fluid can spread along the textile fabric.

In a preferred embodiment, a tensioning device for the textile fabric is provided, which comprises a contact surface for the textile fabric, between which and the metering membrane an edge region of the textile fabric is disposed.

In a further preferred embodiment, the metering membrane contact surfaces are further away from a centre of the metering membrane or from the flexing region of the metering membrane than the contact surface for the textile fabric and/or the contact surface for the textile fabric is further away from a centre of the metering membrane or from the flexing region of the metering membrane than the protective membrane contact surface.

The metering membrane, the protective membrane and the textile fabric thus have separate tensioning devices, so that neither the protective membrane nor the textile fabric can adversely affect the elastic behaviour of the metering membrane.

In a preferred embodiment, the metering diaphragm pump comprises a metering head and a drive head, each of which comprises surfaces that correspond to one another and form the metering membrane contact surfaces, wherein the drive head preferably additionally comprises the protective membrane contact surface and particularly preferably also the contact surface for the textile fabric. The metering membrane, the textile fabric and the protective membrane are therefore disposed between the metering head and the drive head and clamped accordingly.

In a particularly preferred embodiment, the metering membrane contact surfaces are configured such that the metering membrane is pretensioned in the direction of the first or the second position, wherein the metering membrane contact surfaces are preferably conical.

As a result, even if there is no pressure difference at all between the working chamber and the metering chamber, a force is already being exerted on the metering membrane and said membrane is being elastically deformed.

The pretensioning should preferably be selected such that, in contrast to the metering membranes of the prior art, the metering membrane no longer moves around a relaxed state, but only between two positions which are both pretensioned in the same direction. This eliminates the alternating flexing and with it a constant loading and unloading of the edge regions of the metering membrane when the membrane transitions from an outwardly curved state to an inwardly curved state. This measure also ensures that a force in the direction of the second position is constantly exerted on the metering membrane during the suction stroke, so that the metering pump can be hydraulically driven with very low metering fluid pressure.

BRIEF DESCRIPTION OF THE FIGURES

Further advantages, features, and possible applications of the present invention will become apparent from the following description of two preferred embodiments and the associated figures. The figures show.

DETAILED DESCRIPTION

Figure 1:
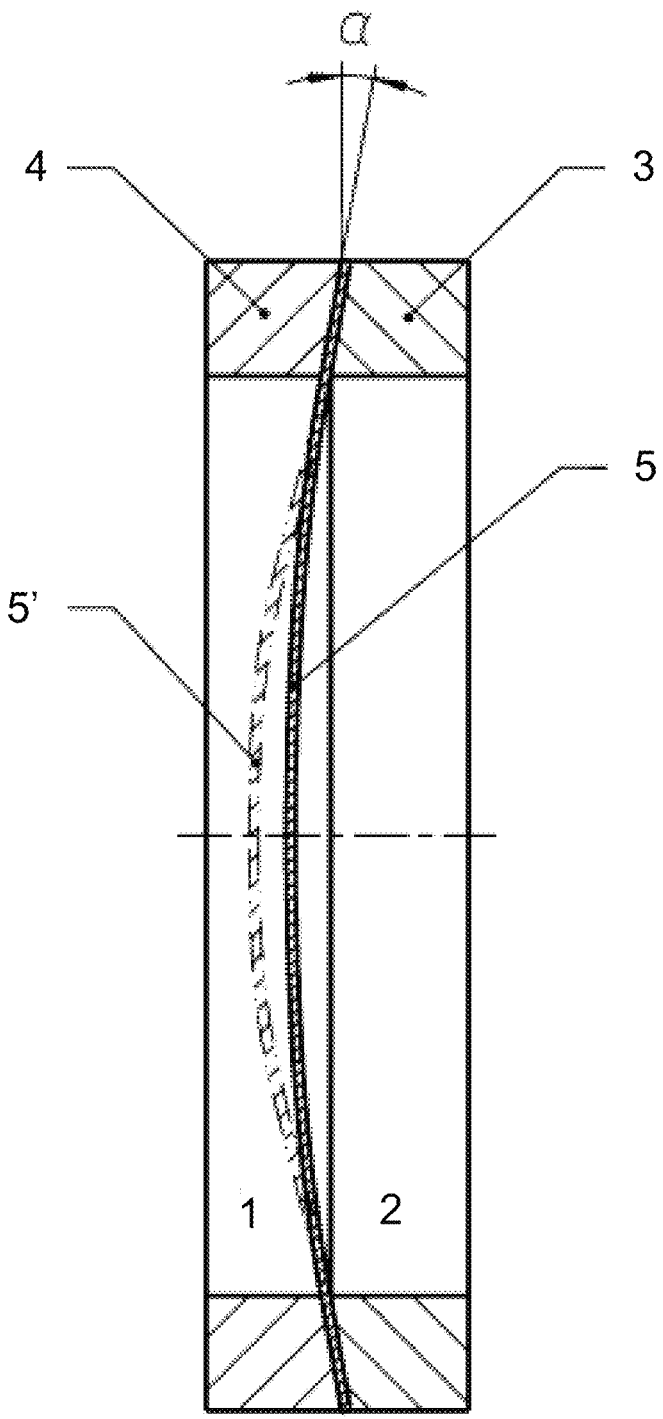
FIG. 1 a schematic cross-sectional view through a metering membrane and its tensioning from the prior art, FIG. 2 a schematic detail cross-sectional view of a first embodiment of the invention, FIG. 2*a* a schematic plan view onto a protective membrane, and FIG. 3 a schematic cross-sectional view of a second embodiment of the invention.

The basic design of the described metering pump is known to the person skilled in the art. Therefore, FIG. 1 only shows a cross-sectional view of a metering membrane 5 which separates a metering chamber 1 from a working chamber 2. The metering membrane 5 is tensioned in its edge regions between the tensioning device 3, 4. The tensioning device 3, 4 consists of two cylindrical elements 3, 4 comprising contact surfaces which face one another and between which the edge region of the metering membrane 5 is clamped. Since the contact surfaces in the shown embodiment are conical with a cone angle $\alpha$, the metering membrane 5 flexes to the left in the situation shown in FIG. 1 when the two cylindrical elements 3, 4 of the tensioning device are move toward one another and the edge region of the membrane is clamped. Consequently, the elastic metering membrane is pretensioned to the left in FIG. 1 by the shown tensioning device.

In the preferred embodiment, the working chamber 2 is filled with a hydraulic fluid which can be pressurized with the aid of an appropriate device, such as a driven piston. If the pressure in the working chamber 2 rises above the pressure in the metering chamber 1, the metering membrane 5 is moved even further to the left. This position is shown schematically with the dashed line 5'. If the pressure in the working chamber 2 is decreased, the membrane moves back to the position shown with the solid line 5'.

Even though the pretensioning described here prevents alternating flexing of the membrane, which significantly increases the service life of the membrane, membrane rupture can still occur in unusual situations and cannot be detected because of the single-layer embodiment.

Figure 2:
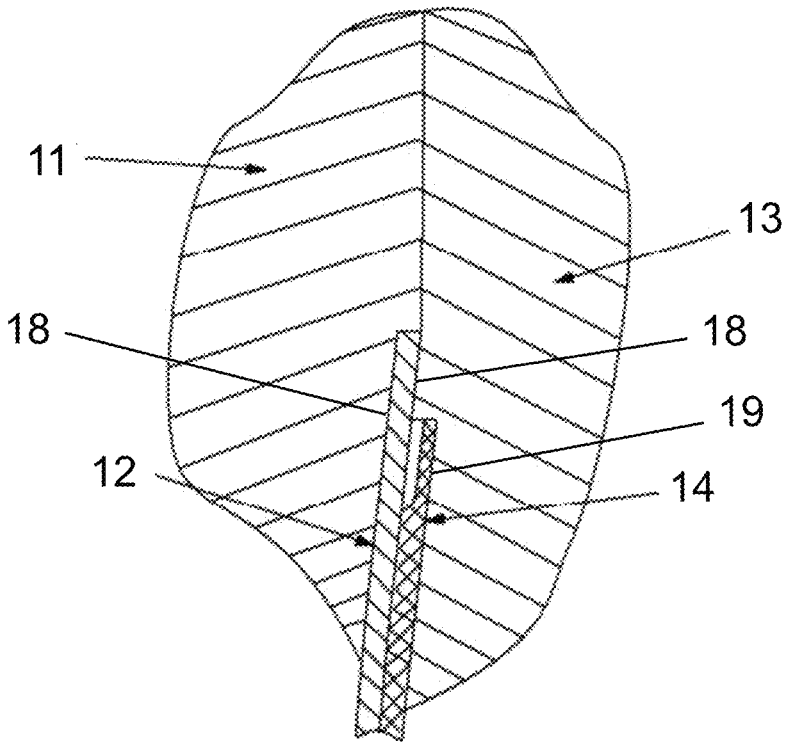

FIG. 2 therefore shows a first embodiment of the metering membrane according to the invention in a partial sectional view. The metering membrane 12 is clamped here in a similar manner with its edge region between two elements 11 and 13. The element 11, which can be provided by the metering head, for example, comprises a metering membrane contact surface 18 on which the edge region of the metering membrane 12 rests. The second element 13, which can be provided by the working head or the hydraulic head, likewise comprises a metering membrane contact surface 18 which is in direct contact with the metering membrane 12. The corresponding metering membrane contact surfaces are conical here too, so that the metering membrane 12 is accordingly pretensioned as already known from the prior art. A protective membrane 14 is provided here, however, which is disposed directly behind the metering membrane 12, i.e., in the direction of the working chamber. This protective membrane 14 does not extend as far between the two elements 11 and 13 as the metering membrane 12. The element 13 comprises the protective membrane contact surface 19 on which the protective membrane rests.

Figure 2A:
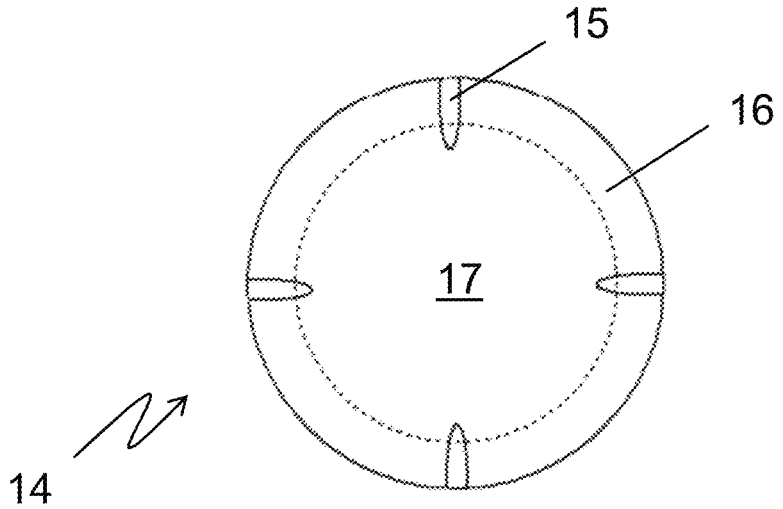

As also in FIG. 2*a*, for example, which shows a schematic plan view onto the protective membrane 14 in the untensioned state, the protective membrane 14 comprises four recesses 15 which extend from the flexing region 17 of the protective membrane to the tensioned edge region 16 of the protective membrane 14. Should metering fluid therefore actually pass through the metering membrane 12, an intermediate space will form between the metering membrane 12 and the protective membrane 14 and be filled with metering fluid. Because of the recesses 15, the metering fluid reaches the protective membrane tensioning region 16 and can be detected there in a known manner.

Figure 3:
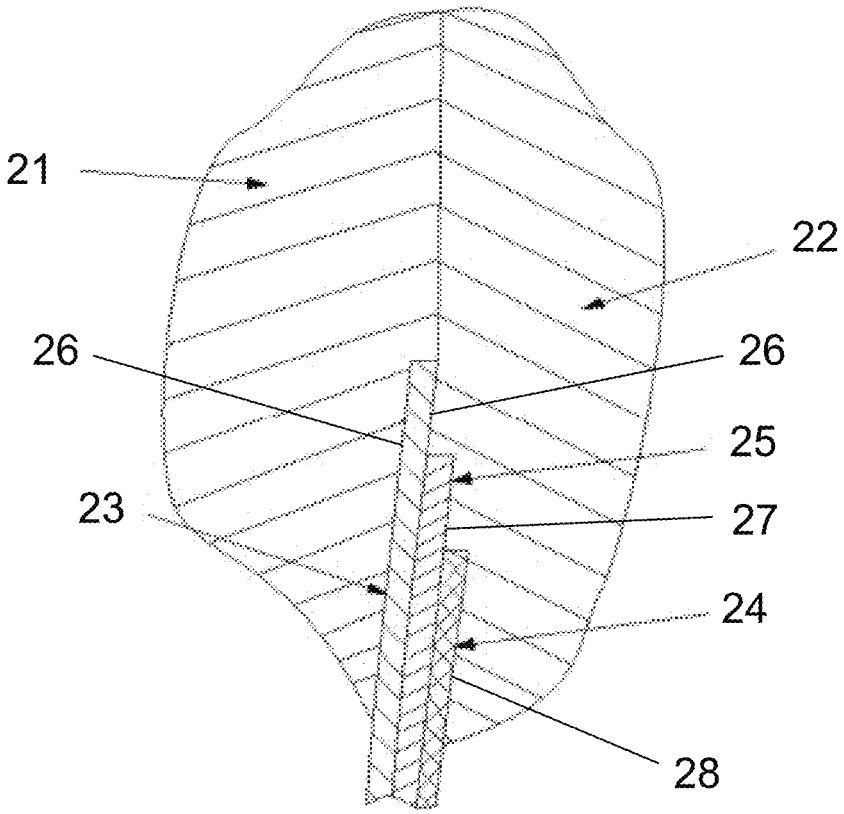

FIG. 3 shows a second embodiment of the invention. Here too, the metering membrane 23 is tensioned between two elements of a tensioning apparatus 21 and 22 in the same manner as in FIG. 2 and the prior art.

However, two further elements, namely a textile fabric 25 and the protective membrane 24, are now disposed here. The textile fabric 25 does not extend as far between the two elements 21 and 22 as the metering membrane 23, so that the movement characteristics of the metering membrane 23 are not affected by the textile fabric. Lastly, the protective membrane 24 extends even less far between the elements 21 and 22 than the textile fabric 25. The metering membrane 23 is tensioned between the metering membrane contact surfaces 26. The textile fabric 25 configured as a woven fabric is tensioned between the contact surface 27 for the textile fabric and the metering membrane 23. The protective membrane 24 is tensioned between the protective membrane contact surface 28 and the textile fabric 25.

Due to the presence of the textile fabric 25, there is no need for the corresponding recesses or milled recesses in the protective membrane 24, because any metering fluid that enters the textile fabric 25, which is preferably configured as a woven fabric, can reach the tensioning region of the textile fabric 25 and be detected there in the known manner.

REFERENCE SIGNS

1 Metering chamber
2 Working chamber
3, 4 Tensioning device, cylindrical elements
5, 5', 12, 23 Metering membrane
14, 24 Protective membrane
11, 13, 21, 22 Tensioning apparatus
15 Recesses
16 Edge region
17 Flexing region
18, 26 Metering membrane contact surface
19, 28 Protective membrane contact surface
25 Textile fabric
27 Contact surface for the textile fabric

The invention claimed is:

1. A metering diaphragm pump, comprising:
a metering chamber;
a working chamber;
a metering membrane made of a flat metal foil; and
a protective membrane disposed directly behind the metering membrane on a working-chamber side,
wherein the metering chamber and the working chamber are separated from one another by the metering membrane,
a device for moving said metering membrane back and forth between a first position and a second position is provided,
a volume of the metering chamber is smaller in the first position than in the second position,
the protective membrane and the metering membrane both have radially outermost edge regions which are clamped between two elements,
the protective membrane does not extend as far between the two elements,
the metering membrane bounds the metering chamber,
the protective membrane
i) bounds the working chamber at a first region,
ii) extends in a single continuous piece from the first region to the edge region of the protective membrane,
iii) is clamped at the edge region, and
the metering membrane is clamped outside the edge region of the protective membrane.

2. The metering diaphragm pump according to claim 1, wherein the protective membrane is made of an electrically insulating material.

3. The metering diaphragm pump according to claim 1, wherein the protective membrane comprises a milled recess on its side facing the metering membrane.

4. The metering diaphragm pump according to claim 1, wherein a metering membrane tensioning device is provided, which comprises two metering membrane contact surfaces that correspond to one another and between which an edge region of the metering membrane is disposed.

5. The metering diaphragm pump according to claim 4, wherein a protective membrane tensioning device is provided that comprises a protective membrane contact surface, an edge region of the protective membrane is disposed between the protective membrane contact surface and the metering membrane, on a side facing the metering membrane, the protective membrane comprises a milled recess which extends into the edge region of the protective membrane.

6. The metering diaphragm pump according to claim 5, wherein the metering membrane contact surfaces are further away from a center of the metering membrane than the protective membrane contact surface.

7. The metering diaphragm pump according to claim 5, wherein a bore, in which a membrane rupture signaling device is disposed, is provided in the protective membrane contact surface.

8. The metering diaphragm pump according to claim 3, wherein a metering membrane tensioning device is provided, which comprises two metering membrane contact surfaces that correspond to one another and between which an edge region of the metering membrane is disposed.

9. The metering diaphragm pump according to claim 6, wherein a bore, in which a membrane rupture signaling device is disposed, is provided in the protective membrane contact surface.

10. The metering diaphragm pump of claim 1, wherein the pump comprises exactly two flexible, liquid-tight membranes, namely the metering membrane and the protective membrane.

11. The metering diaphragm pump of claim 1, wherein edge regions of both membranes are clamped by the same pair of opposed annular clamping faces provided by a metering-head body and a drive-head body.

12. A metering diaphragm pump, comprising:

a metering chamber;

a working chamber;

a metering membrane made of a flat metal foil;

a protective membrane disposed on a working-chamber side; and a textile fabric disposed between the metering membrane and the protective membrane;

wherein the metering chamber and the working chamber are separated from one another by the metering membrane;

a device is provided for moving said metering membrane back and forth between a first position and a second position such that a volume of the metering chamber is smaller in the first position than in the second position;

the protective membrane and the metering membrane each have radially outermost edge regions clamped between two elements;

the protective membrane does not extend as far between the two elements, the metering membrane bounds the metering chamber, the protective membrane i) bounds the working chamber at a first region, ii) extends in a single continuous piece from the first region to the edge region of the protective membrane, iii) is clamped at the edge region, and the metering membrane is clamped outside the edge region of the protective membrane.

13. The metering diaphragm pump of claim 12, wherein a tensioning device for the textile fabric is provided, which comprises a contact surface for the textile fabric, between which and the metering membrane an edge region of the textile fabric is disposed.

14. The metering diaphragm pump of claim 13, wherein the metering membrane contact surfaces are further away from a centre of the metering membrane than the contact surface for the textile fabric and/or the contact surface for the textile fabric is further away from a centre of the metering membrane than the protective membrane contact surface.

15. The metering diaphragm pump of claim 13, wherein a metering head and a drive head are provided, each of which comprises surfaces that correspond to one another and form the metering membrane contact surfaces, and the drive head additionally comprises the protective membrane contact surface and the contact surface for the textile fabric.

16. The metering diaphragm pump of claim 15, wherein the metering membrane contact surfaces are configured such that the metering membrane is pretensioned in the direction of the first or the second position and the metering membrane contact surfaces are conical.

* * * * *